US007832559B1

(12) United States Patent
Hansborough et al.

(10) Patent No.: US 7,832,559 B1
(45) Date of Patent: Nov. 16, 2010

(54) NESTED ROLLED SHEET MATERIAL PACKAGES

(75) Inventors: Mike Hansborough, Avon Lake, OH (US); Joel T. Hageman, Lakewood, OH (US); Jamie O. Morehead, Hiram, OH (US)

(73) Assignee: American Greetings Corporation, Cleveland, OH (US)

( * ) Notice: Subject to any disclaimer, the term of this patent is extended or adjusted under 35 U.S.C. 154(b) by 149 days.

(21) Appl. No.: 11/947,855

(22) Filed: Nov. 30, 2007

(51) Int. Cl.
*B65D 85/00* (2006.01)

(52) U.S. Cl. ..... 206/391; 206/394; 206/225

(58) Field of Classification Search ..... 206/391, 206/394, 408, 413, 414, 415, 416, 493, 225, 206/226, 520; 242/160.2, 170, 588, 899; 211/60.1, 44
See application file for complete search history.

(56) References Cited

U.S. PATENT DOCUMENTS

| | | | | |
|---|---|---|---|---|
| 142,073 | A * | 8/1873 | Bates | 206/391 |
| 1,943,087 | A * | 1/1934 | Potter et al. | 174/107 |
| 3,128,882 | A * | 4/1964 | Kardulas | 211/13.1 |
| 4,153,157 | A * | 5/1979 | deVolpi | 206/225 |
| 4,369,929 | A | 1/1983 | Cayer | |
| 5,104,057 | A * | 4/1992 | Chesler et al. | 242/128 |
| 5,305,937 | A | 4/1994 | Barnett | |
| 5,823,363 | A * | 10/1998 | Cassel | 211/60.1 |
| 6,123,197 | A | 9/2000 | Marquez et al. | |
| 7,134,583 | B2 | 11/2006 | May et al. | |
| 7,428,966 | B2 * | 9/2008 | Goodall et al. | 206/225 |
| 2001/0040111 | A1 | 11/2001 | Spradlin et al. | |
| 2005/0072826 | A1 | 4/2005 | Sewell et al. | |
| 2005/0150924 | A1 | 7/2005 | May et al. | |
| 2006/0032776 | A1 * | 2/2006 | Klein et al. | 206/520 |
| 2007/0018023 | A1 | 1/2007 | Ness | |
| 2007/0074986 | A1 | 4/2007 | King | |
| 2007/0090015 | A1 * | 4/2007 | Chandaria | 206/736 |
| 2007/0163907 | A1 | 7/2007 | Turner | |
| 2007/0793917 | | 8/2007 | Munoz et al. | |

* cited by examiner

*Primary Examiner*—David T Fidei
(74) *Attorney, Agent, or Firm*—Roetzel & Andress

(57) ABSTRACT

Nested rolled sheet material packages have multiple rolls of sheet material each with unique internal and external diameters and nested and held in a telescoping arrangement by a package fixture which fits within a portion of each roll and which is contacted by an end of each roll so that a portion of each roll is visible. The package fixture may be generally planar, cylindrical or conical, and may further include steps for contact with ends of each of the rolls.

24 Claims, 5 Drawing Sheets

NESTED ROLLED SHEET MATERIAL PACKAGES

RELATED APPLICATIONS

There are no applications which are related to this application.

FIELD OF THE DISCLOSURE AND INVENTION

The disclosure and related inventions are in the general field of sheet materials in sheet form, including sheet materials which are packaged or formed in a rolled configurations and packages which include multiple rolls of sheet material.

BACKGROUND OF THE DISCLOSURE AND INVENTION

Sheet material such as paper, plastic films, and metal such as aluminum foil and laminates thereof are commonly produced and packaged in rolled form, often rolled about a cylindrical form tube. Sheet material in rolled form provides high density and volume of material and maintains the material in a smooth wrinkle-free condition. The quantity of material in each roll can be selected according to weight, volume and/or area. Multiple rolls of common material are commonly shipped or packaged in bulk vertically on end, and arranged in rectangular groups. The rectangular packaging of cylindrical rolls results in wasted bulk shipping volume. Depending upon the size of the cylindrical form tube, the interior volume of the tube also results in unused shipping volume.

SUMMARY OF THE DISCLOSURE AND INVENTION

In accordance with the principles and concepts of the disclosure, there is disclosed as one or more particular embodiments a nested rolled sheet material package which includes a plurality of cylindrical rolls of sheet material, each roll of sheet material having a cylindrical form with a unique internal diameter and an external diameter; a package fixture which fits within a portion of each of the rolls of the package, the package fixture having a base which fits within a roll with a largest internal diameter of the package, and a top which fits within a roll with a smallest internal diameter of the package; a first end of the roll with the smallest internal diameter of the package located in the roll with the largest internal diameter of the package, the first end of the roll with the smallest internal diameter of the package contacting the package fixture between the base and top of the package fixture so that a second end of the roll with the smallest internal diameter of the package is spaced from a second of the roll with the largest internal diameter of the package.

The disclosure further includes as a representative embodiment a rolled gift wrap package including a plurality of rolls of gift wrap material, each roll of gift wrap material having a unique internal diameter and external diameter; a package fixture which fits within each of the rolls of the package, the package fixture having a base and a top and a width dimension proximate to the base which is approximately equal to an internal diameter of a roll with a largest internal diameter of the package, and a width dimension proximate to the top which is approximately equal to an internal diameter of a roll with the smallest internal diameter of the package; a first end of the roll with the largest internal diameter of the package positioned over the package fixture proximate to the base of the package fixture, and a first end of the roll with the smallest internal diameter of the package positioned over the package fixture proximate to the top of the package fixture, whereby the first end of the roll with the smallest internal diameter of the package is spaced from the first end of the roll with the largest internal diameter of the package.

DETAILED DESCRIPTION OF PREFERRED AND ALTERNATE EMBODIMENTS

Figure 1:
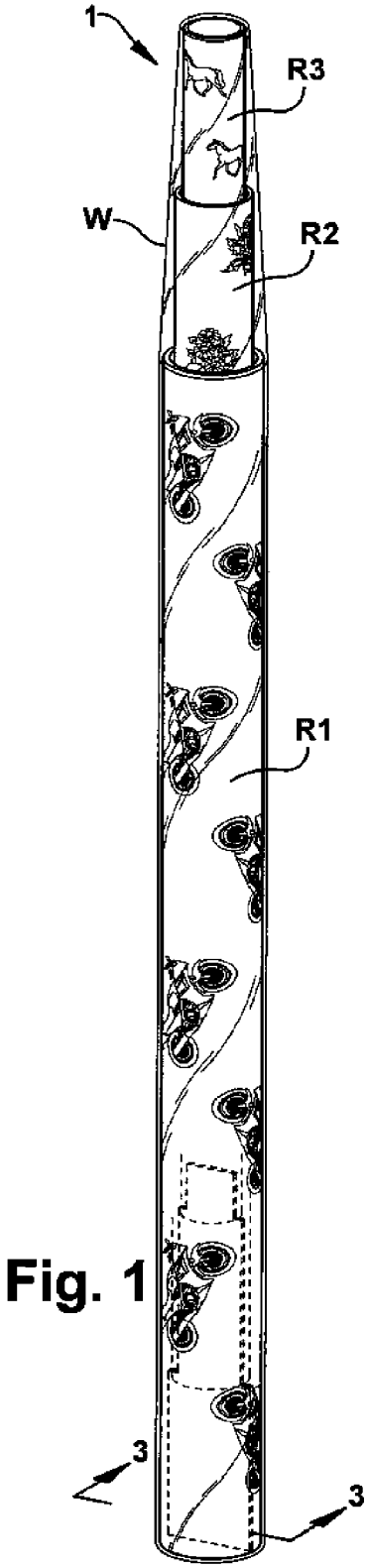
FIG. 1 illustrates a representative embodiment of nested rolled sheet material package of the disclosure.
Figure 2:
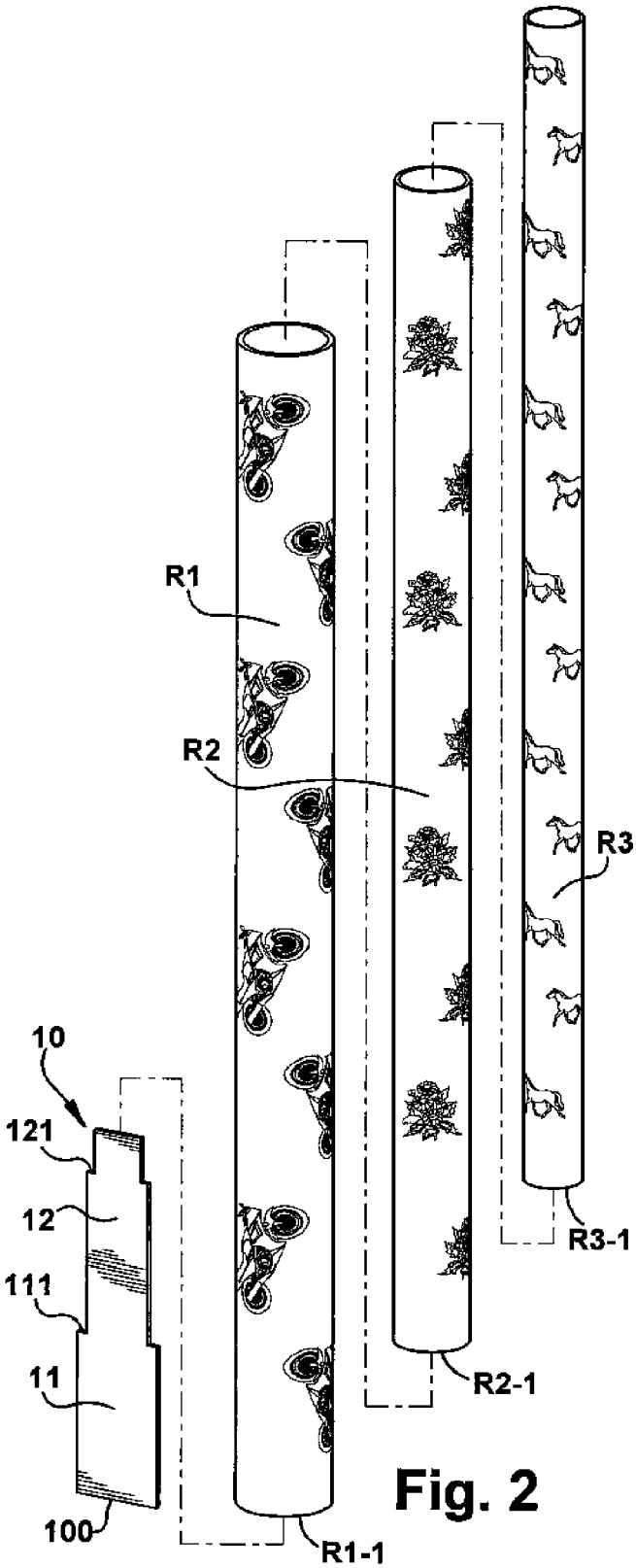
FIG. 2 illustrates an assembly view of the nested rolled sheet material package of the disclosure.
Figure 3:
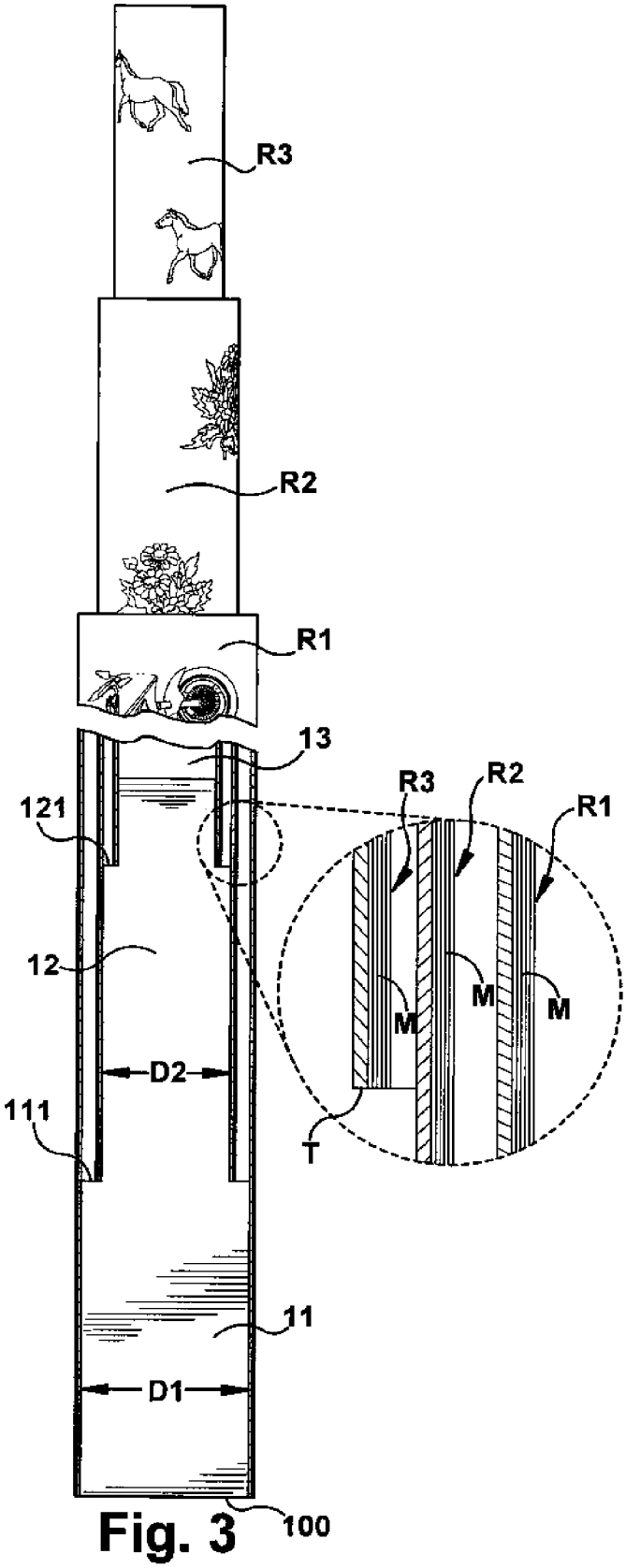
FIG. 3 illustrates a partial cross-sectional view of the nested rolled sheet material package of the disclosure.

FIGS. 1-3 illustrate a nested rolled sheet material package, indicated in its entirety at 1, which includes rolls R1, R2 and R3 (collectively or singularly referred to herein as "roll" or "rolls" R), and which may further include any number of additional rolls, which may be rolls of any type of sheet material, including but not limited to paper, film, metal, laminates or any other material which can be put in, or which are manufactured in the rolled cylindrical form. Although illustrated generally as homogeneous single wall structures, it is understood that each roll may be made up of any sheet material in rolled form, with any amount of cylindrical void or not at the axial center of the roll, and with or without a tube or other cylindrical form or mandrel about which the sheet material is wound, either at the ends or along the lengths of the rolls. Any of the tube forms may be a paper or cardboard type tube or plastic, or made of any other suitable material of combination of materials, and with any structure which provides an exterior cylindrical form about which sheet material may be wound.

As shown in FIG. 1, multiple rolls R may be in a nested arrangement wherein one or more rolls R fit within the interior of a relatively larger roll R, such as roll R3 within roll R2 and both within roll R1. The rolls R in a nested arrangement may be fully or partially within a relatively larger roll, and are shown in FIGS. 1 and 3 in a partially nested or telescoped arrangement wherein a segment of one or more of the nested rolls R extends from an end of the next larger roll R as shown. For certain consumer sheet material products such as gift wrapping material (also referred to herein as "gift wrap" or "rolled gift wrap"), this telescope arrangement makes each of the rolls R of the package 1 at least partially visible while in the packaged form. The telescope arrangement is particularly advantageous for consumer products such as gift wrapping material where it is important for the consumer to be able to see the sheet material on each of the multiple rolls R as to color and/or design patterns and coordination with that of the other combined rolls R. Each roll R may have a cylindrical tube form about which a quantity of sheet material is wound. An internal diameter of the roll R is the internal diameter of the cylindrical tube form, and an external diameter of the roll R is at the surface of the outermost layer of sheet material. Alternatively, the rolls R may include just rolled sheet material without a cylindrical tube form inside the roll, in which case the internal diameter and the external diameter of the roll is defined by the respective winds of the sheet material. The Figures of the disclosure illustrate both forms.

To arrange and hold the rolls R in the described nested or staggered nested or telescope configuration, a package fixture 10 is provided, one embodiment of which is shown in FIGS. 1-3. The package fixture 10 is in this particular form generally planar and has a first segment 11 with a diametric dimension D1 which fits within an internal diameter or dimension of the outermost roll of the package, i.e. roll R1. The package fixture 10 also preferably has a base 100 which is positioned proximate to an end of roll R1, also referred to as the "first end", and referenced as R1-1, but which does not necessarily have to be located at or near an end of roll R1. A length of the first segment 11 can be of any dimension preferably less than a total length of roll R1 and more preferably substantially less than a total length of roll R1. The length dimension is defined by the distance from the base 100 to a first step 111, the location of which determines the extent to which the next roll of the package, i.e. roll R2, will extend from the opposite end of roll R1. Therefore by design the length 110 of the first segment 11 can be set as desired by the location of the first step 111, for the resulting amount or extent of exposure of the next smaller roll R2, the first end of which (R2-1) rests upon the first step 111, as shown in FIG. 3. A second segment 12 of the package fixture 10 has a diametric dimension D2 which fits within the internal diameter of roll with the next smallest internal diameter, i.e. roll R2, and which extends from the first step 111 to a second step 121, between which define a length dimension which in turn defines an extent to which the next smaller roll R3 will extend beyond an opposite end of roll R2, with end R3-1 of roll R3 resting upon and supported by the second step 121, located within roll R1.

A third segment 13 extends from the second step 121 to a top 200 of the package fixture 10. The third segment 13 has a diametric dimension D3 to fit within an internal diameter or volume of a third or additional roll such as roll R3 with a sequentially smaller internal diameter, and which extends beyond an end of roll R2 by the support of first end R3-1 on the second step 121. Although this representative embodiment of the package fixture 10 has only three segments 11, 12 and 13 and two corresponding steps 111 and 121, other embodiments of the invention may of course include different numbers of segments and steps and in different dimensions for different uses and applications. For example, the lengths of the various segments do not have to be uniform, nor does the width or depth of the steps which provide the veering surface for the end of a roll or rolls. The number of rolls about each segment of the package fixture may vary, depending upon the inner diameter of such rolls and the amount and thickness of sheet material on the roll.

As shown in the enlarged area of FIG. 3, each roll R may consist of multiple windings or layers of sheet material M of any kind or type and including any material suitable for wrapping or folding, and with or without a tubular or cylindrical form T (also referred to herein as a "tube form") about which the sheet material M is wound. When the tube form T is present, and end of the tube form T contacts the package fixture and/or respective step of the package fixture in the package.

Figure 4:
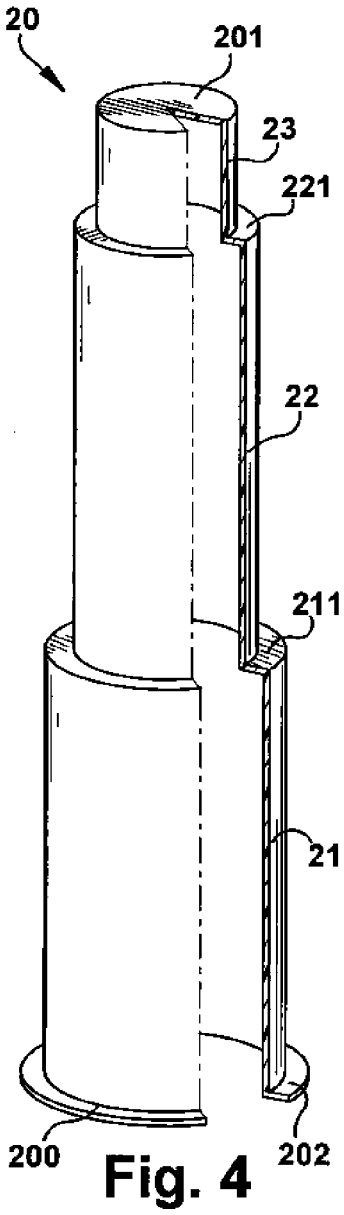
FIG. 4 illustrates a perspective view of a component of an embodiment of the nested rolled sheet material package of the disclosure.

FIG. 4 illustrates an alternate embodiment of a package fixture 20 which is used to form another version of a nested rolled sheet material package of the invention. The package fixture 20 is in a generally cylindrical or conical form, with a base 200, a top 201, and three or more segments, such as segments 21, 22 and 23 of successively smaller outer diameters, and corresponding steps 211 and 221. When formed as a single piece, the segments 22 and 23 can be made to extend from the corresponding steps 211 and 221 as shown, in any lengths as desired. A flange 202 may be formed proximate to the base 200, extending radially outward from the base 200 so that the flange 202 may be contacted by a first end of one of the rolls R, as further described.

Figure 5:
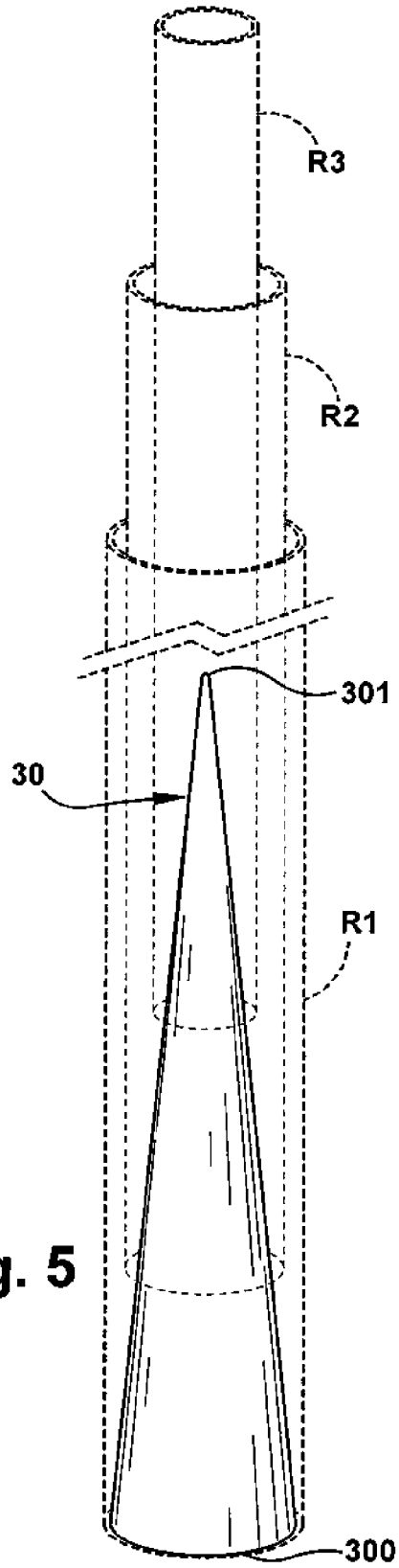
FIG. 5 is a perspective and partial phantom view of a representative embodiment of a nested rolled sheet material package of the disclosure.

The shape of each of the segments does not have to be cylindrical as shown, but can alternatively be any configuration which fits within the internal diameter of the corresponding roll R and which has the corresponding steps to support the respective ends of the rolls, or is without steps. For example and without limitation, the package insert may be in a tapered conical form which supports rolls R of differing internal diameters at different elevations from the base of the insert. FIG. 5 illustrates a generally conical form package fixture 30 which has a base 300 which preferably has a diameter and radius which fits closely within the internal diameter of the largest roll R1 of the package. Alternatively the base 300 may be larger than the internal diameter of roll R1. The apex 301 (also referred to herein as a "top") is located within the interior of the smallest roll, e.g. roll R3, of the package. The apex angle preferably establishes adequate spacing between the rolls R, by the different areas of contacts of the end of each roll, so that an outer diameter of each successively smaller roll fits within an inner diameter of the next larger roll, at the location where the ends of each roll contact the exterior surface of the conical package fixture 30, and the resulting telescopic arrangement of the rolls R.

Figure 6:
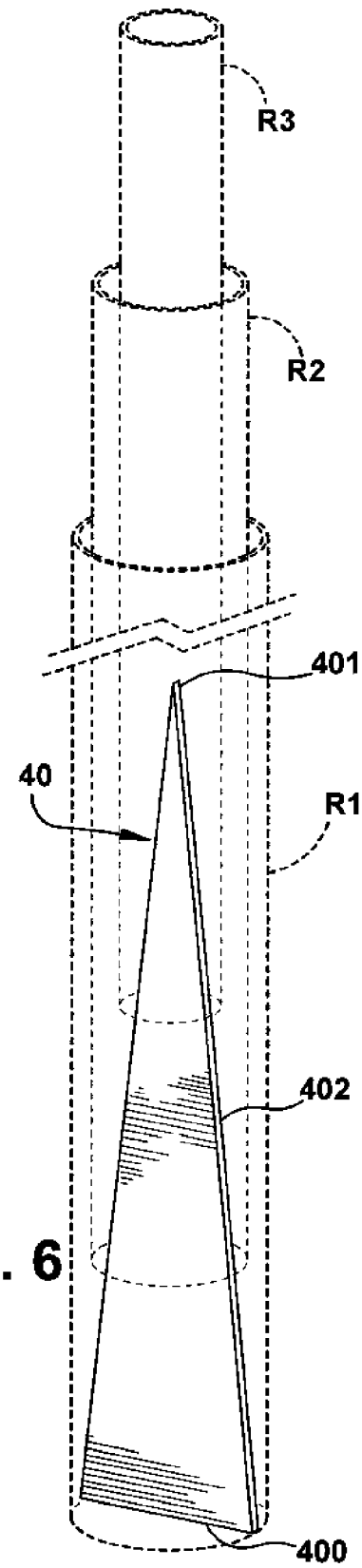
FIG. 6 is a perspective and partial phantom view of a representative embodiment of nested rolled sheet material package of the disclosure.

FIG. 6 illustrates a representative embodiment of a generally planar triangular package fixture 40 with a base 400 which fits within an internal diameter of the largest roll R1 of the package, an apex 401 (also referred to herein as a "top") which is located within the interior of the smallest roll, e.g. roll R1, and an apex angle which preferably spaces apart the intermediate rolls such as roll R2 by contact of the bases of the rolls with the angled sides 402 of the triangular package fixture 40, so that an outer diameter of each successively smaller roll fits within an inner diameter of the next larger roll, at the location where the ends of each roll contact the angled sides of the triangular package fixture 40.

The described package fixtures 10, 20, 30 and 40 are representative of different physical forms which achieve the nested rolled sheet material package construct of two or more cylindrical rolls of sheet material which are telescopically arranged and which contact at one end a package fixture which establishes and maintains the telescopic arrangement between the rolls, making at least a portion of the sheet material on each of the rolls R visible. The disclosure and invention thus includes any physical form of a package insert, whether as a separate component or integral with one or more of the rolls R which results in the described nested or telescoped arrangement of rolls of sheet material.

The rolls R may be held in their relative positions and in relation to the package fixture by friction fit, mechanical or friction lock, adhesive, and/or by an overwrap or shrink-wrap such as a cellophane installed about the package assembly, indicated generally as W in FIG. 1. Representative examples of a friction fit which can hold the package assembly together include, in the planar package fixture a width which is slightly greater than the internal diameters of the respective rolls, or in the cylindrical package fixture the outer diameters of the segments being slightly greater than the internal diameters of the rolls. A friction fit can be achieved with the triangular package fixture embodiments by forcing the first ends of the rolls R onto the package fixture 30 or 40.

Figure 7:
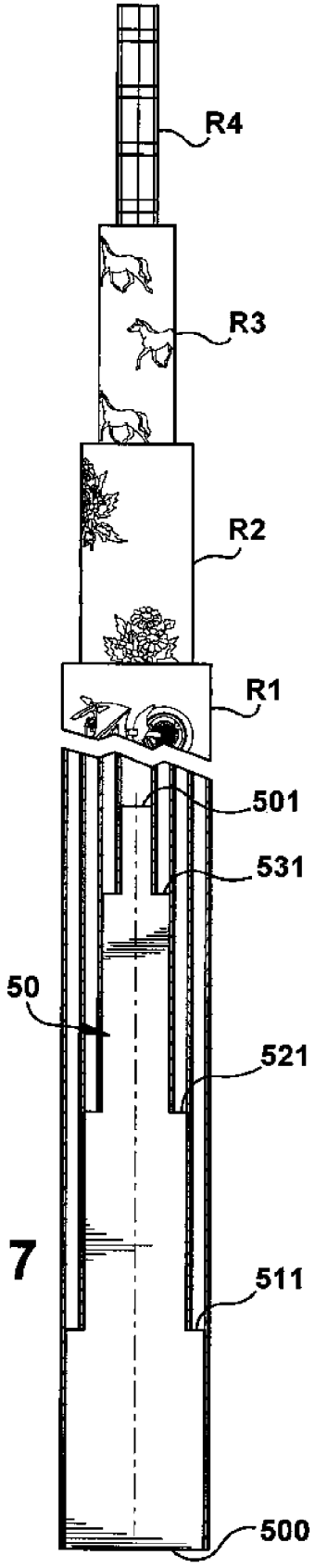
FIG. 7 is an elevation and partial cross-sectional view of a multiple roll rolled gift wrap package of the disclosure.
Figure 8:
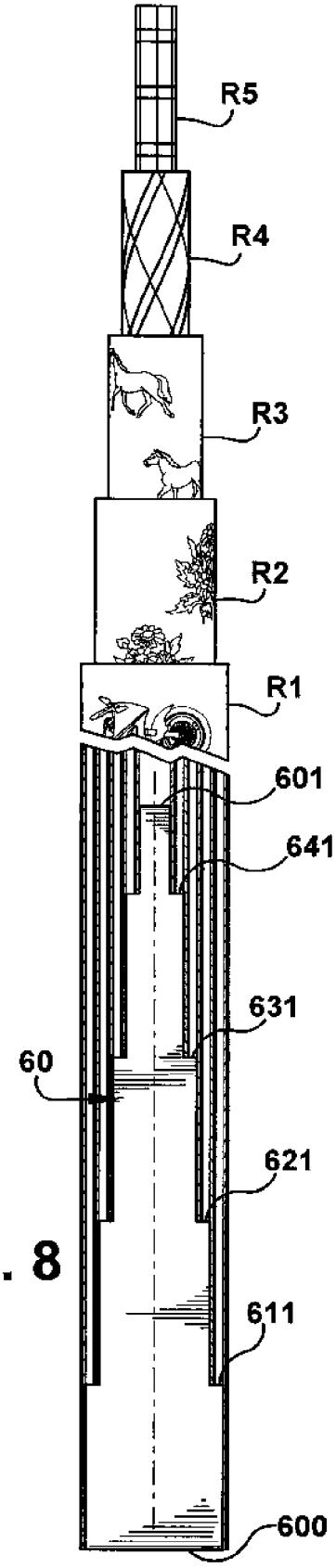
FIG. 8 is an elevation and partial cross-sectional view of a multiple roll rolled gift wrap package of the disclosure.

FIGS. 7 and 8 illustrate alternate embodiments of nested rolled sheet material packages and nested rolled gift wrap material packages of the disclosure which include generally planar or cylindrical or conical package fixtures 50 and 60, with bases 500, 600; tops 501, 601; and multiple steps 511, 521, 531 and 611, 621, 631 and 641 supporting multiple rolls R.

Figure 9:
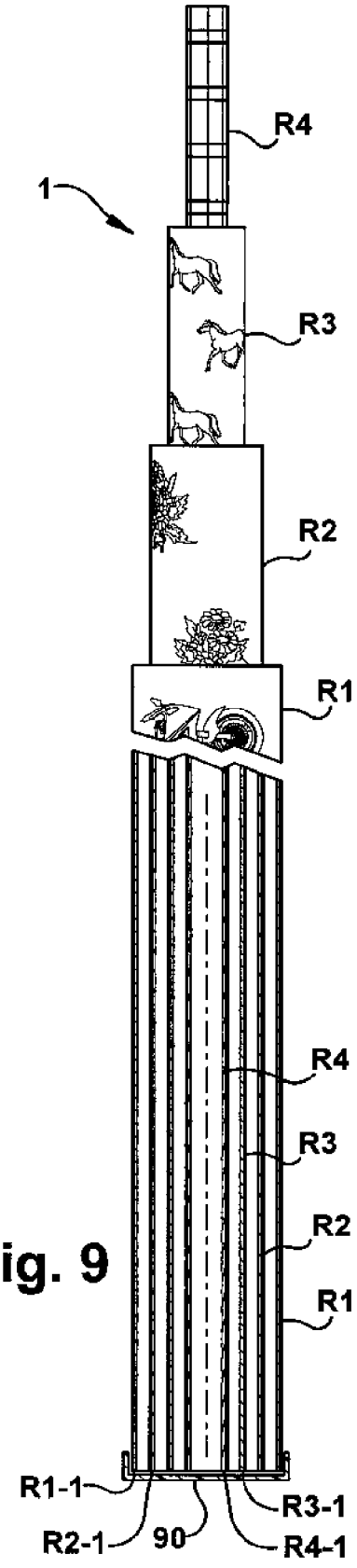
FIG. 9 is an elevation and partial cross-sectional view of a multiple roll rolled gift wrap package of the disclosure.

FIG. 9 illustrates a nested rolled sheet material package 1 in which the multiple rolls R1-R4 are of different lengths, and the respective ends of each roll R1-1, R2-1, R3-1 and R4-1 (also referred to herein as "first ends") are each located at a common elevation which serves as a base or end of the package. The opposite ends for "second ends") of each roll is exposed as a result of the differing lengths of each roll. The progressively greater lengths of rolls R2, R3 and R4 result in their graduated projection from roll R1, and allow for exposure of a portion of the exterior of each roll, which as mentioned is especially beneficial for the packaging of rolled gift wrap material. Another exemplary embodiment would be a package with a total of three nested rolls each of a different length, such as 32 inches, 36 inches and 40 inches. For these embodiments also, the external diameter of each roll may be closely matched to the internal diameter of the next larger roll to achieve a friction fit of each roll within the next larger roll, without relying upon a fixture as previously described to maintain the relative positions. Alternatively or additionally, a cap 90 may be provided at the base of the package about the end of the largest roll R1 to maintain the ends of each of the rolls in alignment, particularly after removal of an outer wrapping such as shrink wrap. An outer wrapping such as cellophane shrink wrap also works will with this embodiment.

The invention claimed is:

1. A nested roll sheet material package comprising a plurality of cylindrical rolls of sheet material, each roll of sheet material having a cylindrical form with identical width measurements, a unique internal diameter and unique external diameter;

a package fixture which fits within a portion of each of the rolls of the package, the package fixture having a base which fits within a roll having an internal diameter that is larger than the internal diameter of all other rolls in the package, and a top which fits within a roll having an internal diameter that is smaller than all other rolls in the package;

a first end of the roll with the smallest internal diameter of the package located in the roll with the largest internal diameter of the package, the first end of the roll with the smallest internal diameter of the package contacting the package fixture between the base and top of the package fixture so that a second end of the roll with the smallest internal diameter of the package is spaced from a second end of the roll with the largest internal diameter of the package.

2. The nested roll sheet material package of claim 1 further comprising at least one additional roll of sheet material with a first end which is located within the roll with the largest internal diameter of the package and which contacts the package fixture between the base and top of the package fixture and between the base and the first end of the roll with the smallest internal diameter of the package so that a second end of the at least one additional roll of sheet material is located between the second end of the roll with the largest internal diameter and the second end of the roll with the smallest internal diameter.

3. The nested rolled sheet material package of claim 1, wherein package fixture is generally planar, flat and non-cylindrical.

4. The nested rolled sheet material package of claim 1, wherein the package fixture further comprises at least one step located between the base and the top of the package fixture, the at least one step configured for contact with the first end of the roll with the smallest internal diameter of the package.

5. The nested rolled sheet material package of claim 2, wherein the package fixture further comprises a step configured to contact the first end of the at least one additional roll of sheet material.

6. The nested rolled sheet material package of claim 5, wherein the package fixture is generally planar, flat and non-cylindrical.

7. A rolled gift wrap package comprising:

a plurality of rolls of gift wrap material, each roll of gift wrap material having a first end and a second end, a unique internal diameter, a unique external diameter and identical width measurements;

a package fixture which fits within each of the rolls of the package, the package fixture having a base and a top and a width dimension proximate to the base which is approximately equal to an inner diameter of a roll having an internal diameter that is larger than all other rolls in the package, and a width dimension proximate to the top which is approximately equal to an internal diameter of a roll having an internal diameter that is smaller than all other rolls in the package;

a first end of the roll with the largest internal diameter of the package positioned over the package fixture proximate to the base of the package fixture, and a first end of the roll with the smallest internal diameter of the package positioned over the package fixture proximate to the top of the package fixture, whereby the first end of the roll with the smallest internal diameter of the package is spaced from the first end of the roll with the largest internal diameter of the package.

8. The rolled gift wrap package of claim 7 further comprising at least one additional roll of gift wrap material with a first end located within the roll with the largest internal diameter and contacting the package fixture at a position between the first end of the roll with the largest internal diameter and the first end of the roll with the smallest internal diameter.

9. The rolled gift wrap package of claim 7, wherein the package fixture is a generally planar fixture with edges which are contacted by the first ends of the rolls.

10. The rolled gift wrap package of claim 9, wherein the package fixture further comprises steps formed in the edges which are contacted by the first ends of the rolls.

11. The rolled gift wrap package of claim 7 further comprising an enclosure which encapsulates each of the rolls of the gift wrap material and the package fixture.

12. The rolled gift wrap package of claim 7, wherein at least one of the rolls of gift wrap material has a tube form about which gift wrap material is wound.

13. The rolled gift wrap package of claim 12, wherein a tube form of at least one roll of gift wrap material is in contact with the package fixture.

14. The nested rolled sheet material package of claim 2 further comprising at least two or more additional rolls of sheet material, the at least two or more additional rolls of sheet material located at least partially within the roll with the largest internal diameter, and the roll with the smallest internal diameter located at least partially within the at least two or more additional rolls of sheet material.

15. The nested rolled sheet material package of claim 1, wherein the package fixture is generally cylindrical.

16. The nested rolled sheet material package of claim 1, wherein the package fixture is generally conical.

17. The nested rolled sheet material of claim 14, wherein the package fixture further comprises at least two steps configured to contact the first ends of the at least two or more additional rolls of sheet material.

18. The nested rolled sheet material package of claim 5, wherein the package fixture is generally cylindrical.

19. The nested rolled sheet material package of claim 17, wherein the package fixture is generally planar.

20. The nested roiled sheet material package of claim 17, wherein the package fixture is generally cylindrical.

21. The rolled gift wrap package of claim 7, wherein the package fixture is generally cylindrical.

22. The rolled gift wrap package of claim 21, wherein the package fixture further comprises steps which are contacted by the first ends of the rolls.

23. The rolled gift wrap package of claim 7, wherein the package fixture is generally conical.

24. The rolled gift wrap package of claim 7, wherein the base of the package fixture has a portion which extends radially beyond the internal diameter of the roll with the largest internal diameter of the package.

* * * * *